United States Patent [19]

Margraf et al.

[11] Patent Number: 4,620,467

[45] Date of Patent: Nov. 4, 1986

[54] FILM CUTTER

[75] Inventors: Dallas A. Margraf, Spring Valley; Fritz F. Treiber, Centerville, both of Ohio

[73] Assignee: Hobart Corporation, Troy, Ohio

[21] Appl. No.: 656,381

[22] Filed: Oct. 1, 1984

[51] Int. Cl.[4] ..... B26D 1/06

[52] U.S. Cl. ..... 83/389; 83/545; 83/610; 83/660; 83/697; 53/389

[58] Field of Search ..... 83/175, 389, 545, 610–612, 83/636, 660, 694, 697, 698, 140; 53/389

[56] References Cited

U.S. PATENT DOCUMENTS

| | | | |
|---|---|---|---|
| 833,470 | 10/1906 | Lipowsky | 83/570 |
| 2,014,765 | 9/1935 | Hoppe | 53/389 X |
| 2,310,719 | 2/1943 | Tuthill et al. | 53/389 X |
| 2,518,838 | 8/1950 | Tempe | 83/660 |
| 3,072,000 | 1/1963 | Bracey et al. | 83/649 X |
| 3,468,202 | 9/1969 | Hollis | 83/175 |
| 3,501,985 | 3/1970 | Baran | 83/660 X |
| 3,533,616 | 10/1970 | Bettenhausen | 83/175 X |
| 3,593,611 | 7/1971 | Sagehorn | 83/697 X |
| 4,208,853 | 6/1980 | English et al. | 53/389 X |
| 4,510,731 | 4/1985 | Mathieu | 53/389 X |

*Primary Examiner*—James M. Meister

*Attorney, Agent, or Firm*—Biebel, French & Nauman

[57] ABSTRACT

An improved film cutter for severing sheets of soft stretch film which is drawn in a plane into a wrapping machine from a continuous source of such film comprises a first elongated knife blade extending laterally across the plane defined by the film and having a serrated cutting edge facing the film. A knife bracket extends laterally across the opposite side of the film plane and forms a channel such that the first knife blade may be moved or inserted into the channel to sever the film. The knife bracket comprises an elongated first member, with a knife mounting bar secured thereto and spaced therefrom to define the channel. The knife mounting bar includes a flange extending away from the channel and toward the film oriented at an acute angle to the knife mounting bar such that the extended edge of the flange forms a thin film contacting edge of the channel. A second knife blade is secured parallel to the knife mounting bar and spaced therefrom, with the second knife blade having a serrated cutting edge facing the film and extending in the channel to a point short of the film contacting edge of the channel.

10 Claims, 7 Drawing Figures

FILM CUTTER

BACKGROUND OF THE INVENTION

This invention relates generally to package wrapping machines and, more particularly, to an improved film cutter for severing sheets of soft stretch film from a continuous source of such film for use in a package wrapping machine.

A popular design of wrapping machine provides for wrapping packages, particularly articles supported on trays, by elevating the packages into stretched film sheets. The film sheets are severed from a continuous source of film by means of a pivotally mounted, cam actuated knife blade. The knife blade includes an upwardly extending serrated cutting edge which is reciprocated through film drawn from the film source. A bracket mounted above the drawn film defines a channel into which the knife blade is inserted to sever a film sheet from the continuous source of film. Such a wrapping machine is fully described in U.S. Pat. No. 4,510,731, and entitled "Film Wrapping Machine Including Film Length Selection," which is assigned to the same assignee as the present application and is incorporated herein by reference.

Film used by the wrapping machine is very soft and stretchy to permit proper wrapping of a package by the machine. Unfortunately, the soft, stretchy characteristics of the film necessary for a good wrap tend to make cutting or severing a film sheet from the continuous source difficult. The serrated cutting edge of the knife blade defines sharp cutting points which initially pierce the film and thereby facilitate cutting or tearing of the film along the length of the cutting blade.

While the prior art film cutter has performed well with films commonly used by the machine, such as films made of polyvinyl chloride, some cutting problems have occurred. Since better and less expensive films are always in demand to improve the art of package wrapping, new films which are more durable and even stretchier have been introduced by film manufacturers. The new films may be produced using different film making techniques or may be made from different materials, such as polyethylene. In any event, such new films tend to be harder to sever and increase the cutting problems encountered when using the prior art film cutter.

Various clamping arrangements can be envisioned by those skilled in the art to ensure that a film sheet is severed from the continuous source of film. However, such clamping arrangements tend to be mechanically complicated, expensive and can produce frictional problems in the operation of the film cutter leading to wear or damage of the driving mechanism for the cutter.

It is thus apparent that the need exists for an improved film cutter to be used on package wrapping machines wherein soft stretch film is drawn from a continuous source and severed into sheets to be wrapped about packages by the wrapping machine. To be effective, the improved film cutter must be reliable, inexpensive and, preferably, be easily incorporated into existing wrapping machines to permit the use of a larger variety of films by the machines.

SUMMARY OF THE INVENTION

In accordance with the present invention, an improved film cutter severs sheets of soft stretch film from a continuous source of such film which is drawn into a wrapping machine in a plane from the continuous source. A first or primary elongated knife blade extends laterally across the plane defined by the film and has a serrated cutting edge facing the film. A bracket formed as a channel extends laterally across the opposite side of the plane defined by the film. The first knife blade and the bracket are mounted for relative movement such that the first knife blade may be moved or inserted into the channel to sever the film. Preferably, the first knife blade is pivotally mounted to perform the relative movement. To ensure that the film is severed, the film is engaged by film engaging means which are mounted within the channel and extend along the film source side of the channel.

After being severed, the film has a tendency to adhere to the side of the channel toward the continuous film source due to static electrical forces which are generated by film handling. To ensure that the film is not so retained, that side of the channel preferably forms a thin film contacting edge and the film engaging means is recessed within the channel a defined distance beyond the film contacting edge.

The film engaging means preferably comprises a second knife blade having a serrated cutting edge for engaging the film. Of course, other film engaging means can be utilized in the present invention. For example, the film engaging means may comprise a plurality of needles having needle points for engaging the film, or a bar having a plurality of pointed members distributed across the bar for engaging the film.

In the illustrated embodiment, the bracket comprises an elongated first member with a film engaging means mounting bar secured thereto and spaced therefrom to define the channel. The mounting bar includes a flange extending away from the channel and toward the film, with the flange being oriented at an acute angle relative to the mounting bar such that the extended edge of the flange forms the thin film contacting edge of the channel. A second knife blade, for the preferred film engaging means, is secured parallel to the mounting bar and spaced therefrom with the second knife blade having a serrated cutting edge facing the film and extending in the channel to a point short of the film contacting edge of the channel.

To stabilize the mounting bar, a stiffening flange may be formed on the edge of the bar opposite to the film. The stiffening flange may extend at any angle, preferably 90°, relative to the mounting bar while the film side flange extends at an angular orientation sufficient to present a thin edge of the end of that flange to film as it is being drawn and severed by the film cutter. Preferably, that angle is approximately 60° relative to the mounting bar. Due to the thin film contacting edge formed by the angularly oriented flange or otherwise, film is not retained against the side of the channel toward the continuous source of film by the static electrical forces generated by handling soft, stretchy wrapping films.

Film drawn into the wrapping machine forms a plane between the reciprocating first or primary knife blade and the bracket which includes, in the preferred embodiment, the stationary second or secondary knife blade. Once a selected length of film has been drawn from the continuous source of film, the primary knife blade is pivotally reciprocated through the film plane and into the channel defined by the bracket. The serrated cutting edges of the primary and secondary knives overlap but are spaced apart from one another and one of the knife blades tends to hold the film against movement while the other severs the film. When two knife blades are used, typically, the sharper of the two serrated cutting edges severs the film and the duller of the two serves to effectively hold the film while it is severed.

The flange extending from the film source side of the mounting bar engages the film as it is severed such that it is not retained by the second knife blade and will return to a proper film engagement position where it can be grasped by a film gripper in accordance with the referenced patent. As previously mentioned, the film side flange is angularly oriented such that only its lower edge, i.e., a thin line of the flange, is in contact with the film. This prevents the film from adhering to the lower flange due to static electrical forces which are generated when handling wrapping film. The flange extending from the film source side of the mounting bar also prevents film as it is being drawn into the machine from engaging the serrated cutting edge of the second knife blade in the event of film flutter which could otherwise cause such contact. By having the lower edge of the flange extend beyond the cutting edge of the secondary knife, the cutting edge of the secondary knife is shielded to prevent operator contact with the knife, for example, as film is being hand-fed into film feeding jaws of the wrapping machine in accordance with the referenced patent.

It is, therefore, an object of the present invention to provide an improved film cutter for a package wrapping machine wherein the effectiveness of a primary knife blade is enhanced by providing film engaging means within a channel defined by a bracket which receives the primary knife blade to ensure that film drawn between the primary knife blade and the bracket is severed as the two are relatively moved such that the primary knife blade is moved or inserted into the channel.

Other objects and advantages of the invention will be apparent from the following description, the accompanying drawings and the appended claims.

DETAILED DESCRIPTION OF THE INVENTION

Figure 1B:
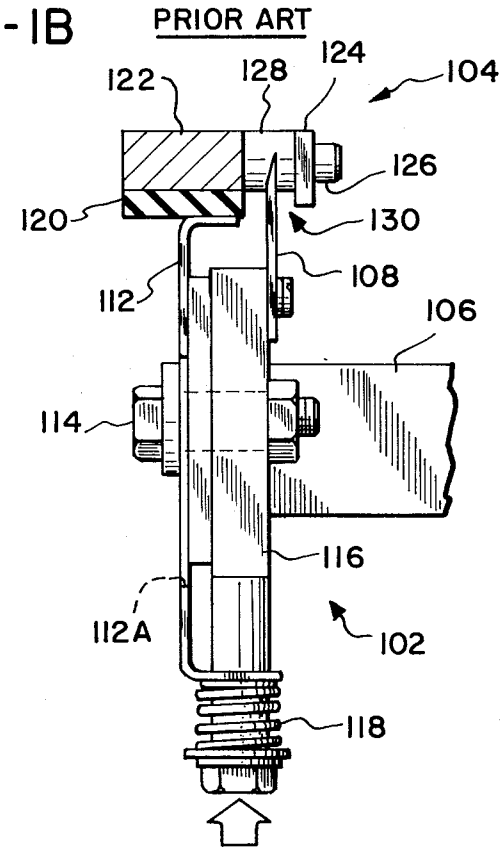
FIGS. 1A and 1B are schematic cross-sectional views showing operation of a prior art film cutter.
Figure 1A:
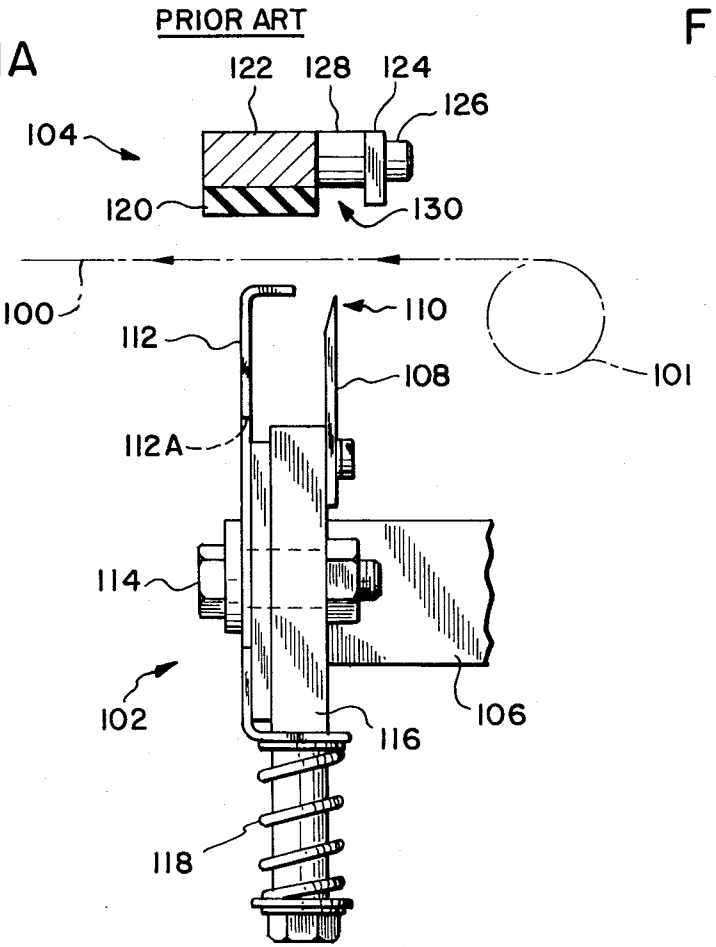

FIGS. 1A and 1B schematically show a crosssection through a prior art film cutter similar to the film cutter of the referenced patent application. In the prior art film cutter of FIGS. 1A and 1B, film is drawn in a horizontal plane 100 from a continuous source of film 101 to extend between a pivoting knife member 102 and a stationary bracket 104. The pivoting knife member 102 is supported on pivot arms 106 (one shown) which extend to a pivot point (not shown) in accordance with the referenced patent.

Figures 3, 3A, 3B:
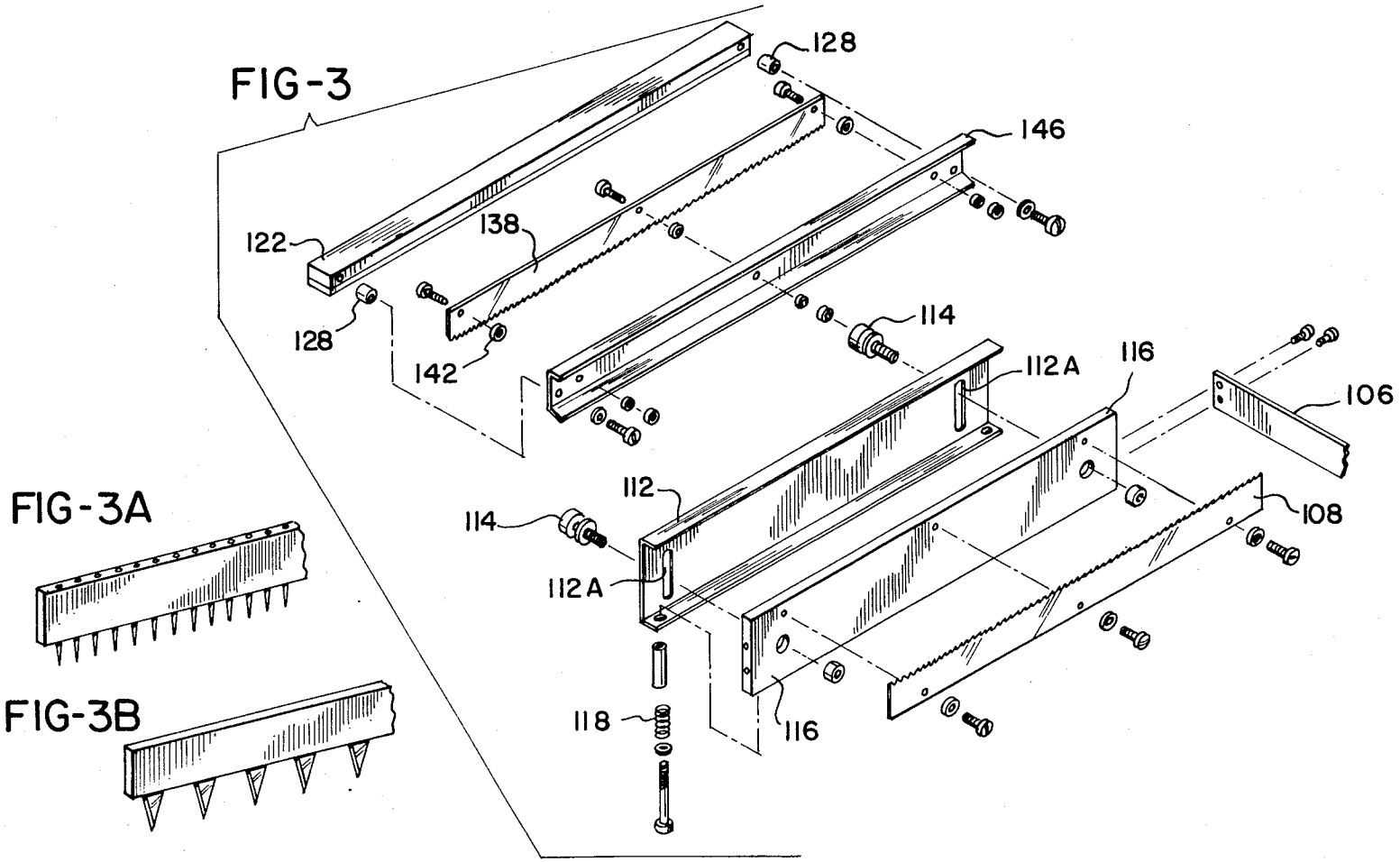
FIG. 3 is a schematic perspective view of the two-bladed film cutter in accordance with the present invention showing the parts as they would appear on the film wrapping machine of the referenced patent.
FIGS. 3A and 3B show alternate film engaging means for the improved film cutter of the present invention.

The pivoting knife member 102 includes an elongated first or primary knife blade 108 which extends laterally across the film drawn into the wrapping machine beneath the plane 100 defined by the film. The knife blade 108 has an upper serrated cutting edge 110, the same as the upper edge of the first or primary knife blade of the present invention, as best seen in FIG. 3.

A spring-loaded film clamp 112 is mounted on the pivoting knife member 102 by means of slots 112A through which bolts 114 are received. The film clamp 112 is forced to an uppermost position against a knife support 116 by means of a compression spring 118. The film clamp 112 engages a film sheet against a facing resilient clamping strip 120 of the knife bracket 104 when the pivoting knife member 102 is pivoted upwardly. The clamping action performed by the clamp 112 and the clamping strip 120 retains the severed edge of a film sheet for longitudinal stretching of the film sheet in accordance with the wrapping procedures of the referenced patent, and to some extent, assists in severing the film sheet from the continuous source of film 101.

The stationary bracket 104 comprises a first member 122 to which a second member 124 is secured by means of Allen screws 126 or the like. The first and second members 122 and 124 are separated by spacers 128 to define a channel 130 into which the knife blade 108 is inserted when the pivoting knife member 102 is moved to its uppermost position, as shown in FIG. 1B. The film between the pivoting knife member 102 and the stationary bracket 104 is severed by the serrated cutting edge 110 of the knife blade 108 as it extends into the channel 130 defined by the stationary bracket 104.

As previously mentioned, the prior art film cutter functions acceptably for many wrapping films; however, for some of the newer, stretchier films it may fail to completely sever a film sheet from the continuous source of film 101. One solution to correct the failings of the prior art film cutter would be to provide a secondary film clamp which would interact with the second member 124 of the stationary knife bracket 104 in a manner similar to that shown for the film clamp 112. Unfortunately, while a secondary film clamp may correct the film cutting deficiencies of the prior art film cutter, it is mechanically complicated, expensive and leads to frictional forces which can damage the driving elements which pivotally reciprocate the pivoting knife member 102.

Figure 2B:
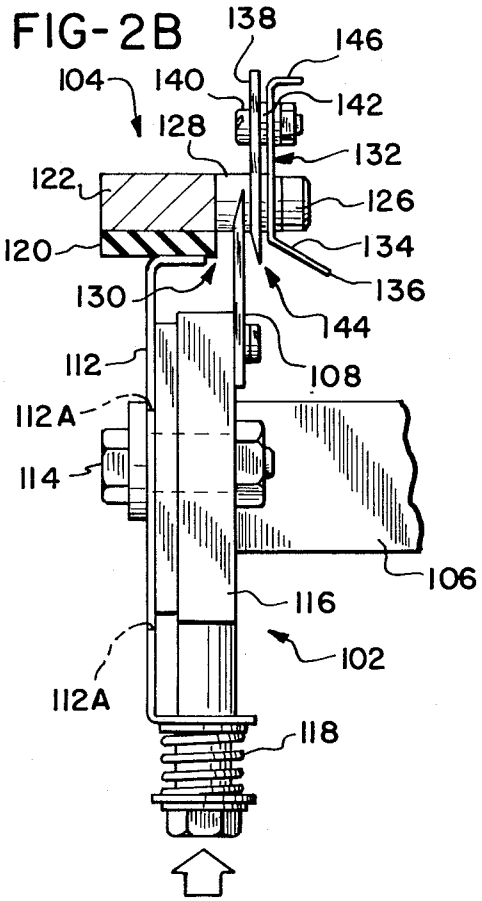
FIGS. 2A and 2B are schematic cross-sectional views showing operation of the improved film cutter in accordance with the present invention.
Figure 2A:
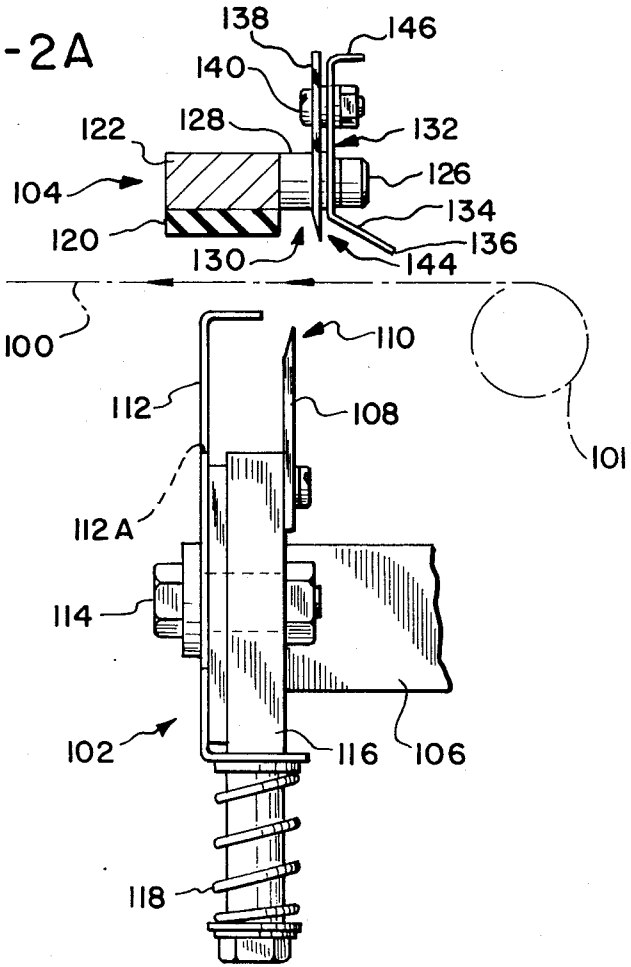

To overcome the problems of the prior art film cutter of FIGS. 1A and 1B, an improved two-bladed film cutter in accordance with the present invention is illustrated in FIGS. 2A, 2B and 3. In accordance with the illustrated embodiment of the present invention, the second member 124 of the stationary bracket 104 is removed by removing the Allen screws 126. In place of the second member 124, a film engaging means of knife mounting bar 132 is connected to complete the stationary bracket 104.

The mounting bar 132 is secured to the first member 122 by means of the Allen screws 126 and the spacers 128 to reform the stationary bracket 104. The channel 130 into which the knife blade 108 is inserted when the pivoting knife member 102 is moved to its uppermost position is still defined by the modified stationary bracket 104 as shown in FIG. 2B. The mounting bar 132 has an angularly oriented flange 134 extending beyond and away from the channel 130 along the edge of the mounting bar 132 toward the continuous source of film 101, which flange will be referred to as a film side flange herein.

The film side flange 134 is oriented at an acute angle, preferably approximately 60°, relative to the mounting bar 132. The angular orientation of the flange 134 relative to the mounting bar 132 presents a thin edge 136 to contact film being severed by the improved film cutter. By presenting the thin edge 136 to the film, the film is not retained against the angularly oriented flange 134 by the static electrical forces which are generated when handling wrapping film. Of course, the side of the channel 130 toward the film source can be formed in a variety of ways to present a thin edge suitable for the present invention as will be apparent to those skilled in the art.

In the embodiment illustrated in FIGS. 2A, 2B and 3, film engaging means comprise a second or secondary knife blade 138 which is secured in parallel to the mounting bar 132 by screws 140. The second knife blade 138 is spaced from the mounting bar 132 by means of spacing washers 142. The spacing between the second blade 138 and the mounting bar 132 prevents film from being jammed therebetween which could prevent the film from returning to the proper position to be engaged by a film gripper in accordance with the referenced patent. Alternate film engaging means may comprise needles or a bar having pointed extensions as shown in FIGS. 3A and 3B, respectively. Additional film engaging means for use in the present invention will be apparent to those skilled in the art.

The second knife blade 138 has a serrated cutting edge 144 extending downwardly in the channel 130 to a point which is above or inside the film contacting distal edge 136 of the angularly oriented flange 134. The exact spacing of the second knife blade 138 relative to the film contacting edge 136 of the flange 134 is not important to the present invention provided only that the cutting edge 144 extends only to a point which is short of the flange edge 136. The extension of the film contacting edge 136 of the flange 134 beyond the serrated cutting edge 144 prevents contact of film with the cutting edge 144 which may otherwise occur and also serves to prevent an operator from making contact with the cutting edge 144 as film is hand fed between film feeding jaws of the wrapping machine in accordance with the referenced patent. If film contacts the cutting edge 144, it may be scratched or slit and therefore tear when stretched or heat sealed to a wrapped package.

The cutting edges 110 and 144 of the first and second blades 108 and 138 overlap one another when the pivoting knife member 102 is elevated to its uppermost position as shown in FIG. 2B. The first and second knife blades 108 and 132 are also separated from one another by a distance of approximately 0.010 of an inch and, hence, do not contact one another during the film severing operation. Preferably, the mounting bar 132 further includes an upper flange 146 for stiffening the mounting bar 132 to stabilize and better support the secondary knife blade 138.

Film drawn into the wrapping machine forms a plane 100 between the reciprocating first blade 108 and the stationary second knife blade 138. While the film plane is horizontal for the package wrapping machine of the referenced patent, it is noted that the film cutter of the present application is applicable to film drawn in a vertical plane or at an angle inclined from horizontal. After a selected length of film has been drawn from the continuous source of film 101, the first knife blade 108 is raised through the plane 100 of the film and into the channel 130 defined by the stationary bracket 104. The serrated cutting edge 110 of the first knife blade 108 and the serrated cutting edge 144 of the second knife blade 138 engage the film with one of the serrated cutting edges 110 or 144 tending to hold the film against movement while the other severs the film. Typically, the sharper of the two serrated cutting edges 110,144 severs the film and the duller of the two serves to effectively hold the film while it is severed.

The lower flange 134 of the mounting bar 132 holds the film as it is severed such that it is not retained by the second knife blade 138 within the serrations of the serrated cutting edge 144. The spacing between the second knife blade 138 and the knife mounting bar 132 ensure that the film will not be pinched therebetween and, hence, retained within the stationary bracket 104. Accordingly, the film returns to a proper film engagement position where it is grasped by a film gripper in accordance with the referenced patent.

While the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. In a package wrapping machine wherein soft stretch film for wrapping packages is drawn in a plane into said machine from a continuous source of said film, an improved film cutter for severing film sheets from said continuous source comprising:

a first knife blade extending laterally across the plane defined by said film on one side thereof and having a serrated cutting edge facing the film;

a bracket extending laterally across the plane defined by said film on the side of said film opposite to said first knife blade, said first knife blade and said bracket being relatively movable and said bracket comprising an elongated first member and a mounting bar secured thereto and spaced therefrom to define a channel such that said first knife blade may be moved into said channel to sever said film, said mounting bar having a flange oriented at an acute angle relative thereto to form a thin film contacting edge adjacent the plane defined by said film and extending away from said channel and toward said continuous source of film whereby film is not retained against said bracket by the static electrical forces generated when handling said film; and film engaging means mounted within and extending along said channel for engaging said film between said first knife blade and said continuous source of film to facilitate the severance of said film, said film engaging means comprising a second knife blade secured parallel to said mounting bar and spaced therefrom, said second knife blade having a serrated cutting edge facing the film and extending in said channel to a point short of said film contacting edge.

2. In a package wrapping machine wherein soft stretch film for wrapping packages is drawn in a plane into said machine from a continuous source of said film, an improved film cutter for severing film sheets from said continuous source comprising:

a first knife blade extending laterally across the plane defined by said film on one side thereof and having a serrated cutting edge facing the film;

a bracket mounted on the opposite side of the plane defined by said film, said bracket comprising a first elongated member and a mounting bar connected to and spaced from said first elongated member to define a channel, said first knife blade and said bracket being relatively movable such that said first knife blade may be moved into said channel to sever said film, said mounting bar being positioned toward said continuous source of film and having a flange extending away from said channel along the edge of said mounting bar facing the plane defined by said film, said flange being oriented at an acute angle relative to said mounting bar; and film engaging means facing the film and being secured in parallel to said mounting bar and spaced therefrom, said film engaging means extending in said channel to a point inside the distal edge of said angularly oriented flange.

3. An improved film cutter as claimed in claim 2 wherein said film engaging means comprises a second knife blade having a serrated cutting edge.

4. An improved film cutter as claimed in claim 3 wherein said mounting bar further comprises a stiffening flange on the edge of said mounting bar opposite to the film.

5. An improved film cutter as claimed in claim 4 wherein said flange extends at an angle of approximately 60° relative to said mounting bar.

6. An improved film cutter as claimed in claim 4 wherein the orientation of said angularly oriented flange is at a sufficient angle to present a thin edge of the end of said flange to film as the film is being drawn and severed by said film cutter whereby film is not retained against said angularly oriented flange by the static electrical forces generated when handling said film.

7. In a package wrapping machine wherein soft stretch film for wrapping packages is drawn in a plane into said machine from a continuous source of said film, an improved film cutter for severing film sheets from said continuous source comprising:

an elongated primary knife blade extending laterally across the plane defined by said film on one side thereof, said primary knife blade having a serrated cutting edge facing said film and being mounted for reciprocating movement through said plane;

a bracket extending laterally across the plane defined by said film on the side of said film opposite to said primary knife blade, said bracket comprising an elongated first member and a mounting bar secured thereto and spaced therefrom to form an elongaed channel positioned to receive the cutting edge of said primary knife blade when moved to a film severing position, said mounting bar being positioned toward said continuous source of film and having an angularly oriented flange extending outwardly from said elongated channel along the edge of said mounting bar which faces said film; and an elongated secondary knife blade secured parallel to said mounting bar and spaced therefrom, said secondary knife blade having a serrated cutting edge extending toward said film in said channel and positioned such that the cutting edges of said primary and secondary knife blades overlap but do not engage one another when said primary knife blade is moved to a film severing position, the end of said angularly oriented flange extending beyond the cutting edge of said secondary knife blade to shield and prevent film and operator contact with the cutting edge of said secondary knife blade, yet permitting the serrated cutting edge of the secondary knife blade to engage said film during cutting operations.

8. An improved film cutter as claimed in claim 7 wherein said mounting bar further comprises a stiffening flange on the edge of said mounting bar opposite to said film.

9. An improved film cutter as claimed in claim 8 wherein said angularly oriented flange extends at an angle of approximately 60° relative to said mounting bar.

10. An improved film cutter as claimed in claim 8 wherein the orientation of said angularly oriented flange is at a sufficient angle to present a thin edge of the end of said flange to film as it is being drawn and severed by said film cutter whereby film is not retained against said angularly oriented flange by the static electrical forces generated when handling said film.

* * * * *